US008806780B2

(12) United States Patent
Restrepo et al.

(10) Patent No.: US 8,806,780 B2
(45) Date of Patent: Aug. 19, 2014

(54) HEEL PROTECTOR

(75) Inventors: Rebecca Restrepo, Jackson Heights, NY (US); Joanna Giles, Maplewood, NJ (US)

(73) Assignee: The Shoe Schell, Jackson Heights, NY (US)

( * ) Notice: Subject to any disclaimer, the term of this patent is extended or adjusted under 35 U.S.C. 154(b) by 449 days.

(21) Appl. No.: 13/178,203

(22) Filed: Jul. 7, 2011

(65) Prior Publication Data

US 2013/0008060 A1 Jan. 10, 2013

(51) Int. Cl.

| | |
|---|---|
| ***A43B 13/22*** | (2006.01) |
| ***A43B 11/00*** | (2006.01) |
| ***A43B 23/30*** | (2006.01) |
| ***A43B 3/16*** | (2006.01) |

(52) U.S. Cl.

CPC ..... *A43B 23/30* (2013.01); *A43B 3/166* (2013.01)

USPC ..... 36/72 B

(58) Field of Classification Search

CPC ..... A43B 23/30; A43B 3/166; A43B 3/16

USPC ..... 36/72 B, 72 R, 58.6, 58.5, 76 HH, 70 R, 36/92, 7.1 R

See application file for complete search history.

(56) References Cited

U.S. PATENT DOCUMENTS

| | | | | | |
|---|---|---|---|---|---|
| 1,620,401 | A | * | 3/1927 | Smock | 36/72 B |
| 1,820,679 | A | * | 8/1931 | Sawyer | 36/72 B |
| 2,894,339 | A | * | 7/1959 | Shapiro | 36/72 B |
| 4,461,100 | A | * | 7/1984 | Minor et al. | 36/72 B |
| D288,382 | S | * | 2/1987 | Birchwood | D2/915 |
| 4,785,556 | A | * | 11/1988 | Blair | 36/7.3 |
| 5,044,097 | A | * | 9/1991 | Young | 36/72 B |
| 7,730,638 | B2 | * | 6/2010 | Urbach et al. | 36/72 B |
| 7,971,373 | B2 | * | 7/2011 | Epping | 36/42 |

FOREIGN PATENT DOCUMENTS

| | | | | |
|---|---|---|---|---|
| DE | 3424811 | A1 | * | 1/1986 |
| GB | 2223157 | A | * | 4/1990 |

* cited by examiner

*Primary Examiner* — Jila M Mohandesi
(74) *Attorney, Agent, or Firm* — Meister Seelig & Fein LLP

(57) ABSTRACT

A heel protector is provided that has a tubular structure with a strap and a heel section. The heel section includes a plurality of alternating annular strips of material and annular ridges that allow users of the heel protector to expand the heel section vertically when placed over a shoe so that the heel section covers all or substantially all of a rear portion of the shoe.

14 Claims, 6 Drawing Sheets

HEEL PROTECTOR

BACKGROUND

The present application relates to accessories and more particularly shoe protectors.

Wear and scuffing of a heel and back of a shoe often occur while driving, particularly for the shoe on the right foot which is used to press the accelerator and brake pedals. A number of heel protectors have been proposed. U.S. Pat. No. 4,756,097, for example, provides a protector for a ladies shoe. U.S. Pat. No. 4,825,563 provides similar protection for flat shoes. In addition to other drawbacks, these protectors only apply to either high heel shoes or flat shoes, and are thus not generally usable to protect other types of shoes.

Accordingly, there is a need for a heel protector that can be used to protect the heels and backs of shoes having various types, sizes and configurations, that can be used safely while driving, and that is lightweight and portable.

SUMMARY OF THE INVENTION

In at least one embodiment, a heel protector is provided that has a tubular structure with a strap section and a heel section. The heel section may include an expandable structure having a plurality of alternating annular strips of material and annular ridges that makes the heel section therewith expandable vertically.

In at least one embodiment the tubular structure is made from a stretchable material, such as silicon, rubber, latex, spandex, and gel.

In at least one embodiment the strap and the heel section form a continuous tubular structure.

In at least one embodiment, a method is provided that includes passing a shoe through a tubular structure of a heel protector, the heel protector having a strap and a heel section, the heel section comprising an expandable structure including a plurality of alternating annular strips of material and annular ridges, the heel section therewith expandable vertically; locating the strap over a front of the shoe; locating the heel section over a heel of the shoe; and expanding vertically the heel section to thereby cover the heel of the shoe.

In at least one embodiment, the method further includes expanding the heel section so that the heel section covers the heel of the shoe and at least a rear portion of the shoe.

In at least one embodiment, the method further includes expanding the heel section so that the heel section covers the heel of the shoe and a rear portion of the shoe, the heel section expanded to cover from a base of the heel to a top of the rear portion of the shoe.

In at least one embodiment, the method further includes forming a loop by crossing the strap and passing the loop over a toe section of the shoe.

In at least one embodiment, the method further includes locating the loop at an incline of a sole of the shoe.

In at least one embodiment, the method is provided that includes passing a shoe through a tubular structure of a heel protector, the heel protector having a strap and a heel section, the heel section comprising a plurality of alternating annular strips of material and annular ridges, the heel section therewith expandable vertically; locating the strap over a front of the shoe; locating the heel section over a heel of the shoe; expanding vertically the heel section so that the heel section covers the heel of the shoe and at least a rear portion of the shoe; forming a loop by crossing the strap and passing the loop over a toe section of the shoe; and locating the loop at an incline of a sole of the shoe.

Additional aspects of the present invention will be apparent in view of the description which follows.

BRIEF DESCRIPTION OF THE FIGURES

FIGS. 5*a*-4*b* show a heel protector according to one other embodiment of the heel protectors disclosed herein.

DETAILED DESCRIPTION

The present application provides heel protectors and methods of using heel protectors with a design that can be used with more than one type of shoe, including high heels, flat shoes, male and female shoes, etc.

Figure 1A:
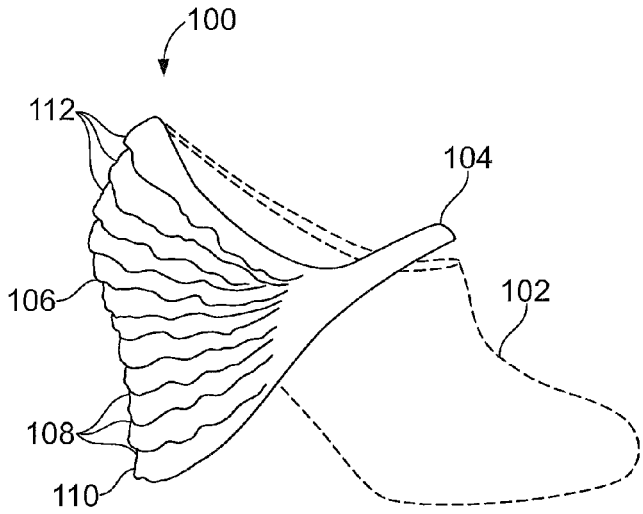
FIGS. 1*a*-1*b* show a heel protector according to one embodiment of the heel protectors disclosed herein.
Figure 1B:
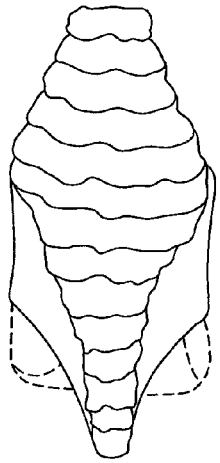

Referring to FIGS. 1*a*-1*b*, a heel protector according to one embodiment includes a tubular structure 100. The tubular structure 100 may be continuous, i.e., without any opening in the wall of the tubular structure, or have an opening therein with a closing mechanism, such as a snap(s) or buckle(s), allowing the structure to be placed around the wear's foot and fastened in position. The tubular structure 100 generally includes a strap section 104 and a heel section 106. The closing mechanism may be located at the strap section 104 (not shown). In at least one embodiment, the strap section 104 is a relatively narrow band of material that interfaces on each end of the strap to the heel section 106. In other embodiments the strap section may be wider or broader. The heel section 106 transitions from the dimensions, e.g., height, of the strap section 104 to a height sufficient to cover all or substantially the entire heel and rear portion of a shoe. In at least one embodiment, the protector is made from a pliable, stretchable material, such as silicon, rubber, latex, spandex, gel, or a combination thereof. In this respect, the protector or at least the heel section 106 may have an initial size that is expanded vertically to fit over a shoe as will be discussed in greater detail below. In this instance, the initial size of the heel section may have a height of about 3 inches and a width of about 2½ inches.

In at least one embodiment, the heel section 106 includes a plurality of annular ridges 108 that give at least the heel section 106 a clam shell appearance. The heel section 106 therefore includes alternating annular strips of material 112 separated by annular ridges 108. The strips 112 provide sufficient material to protect a shoe, while the ridges 108 provide additional stretchability, as compared to a heel section without ridges 108, as a result of the ridges 108 having a smaller thickness of material as compared to that of the strips 112. Expandability, aside from the stretchability of the material from which the heel section 106 is made, may be provided with the heel section 106 having sufficient height to form a plurality of overlapping folds when worn. The heel protector may also include a base 110 that is molded to fit around and/or under the base of the heel of a shoe.

Figure 2A:
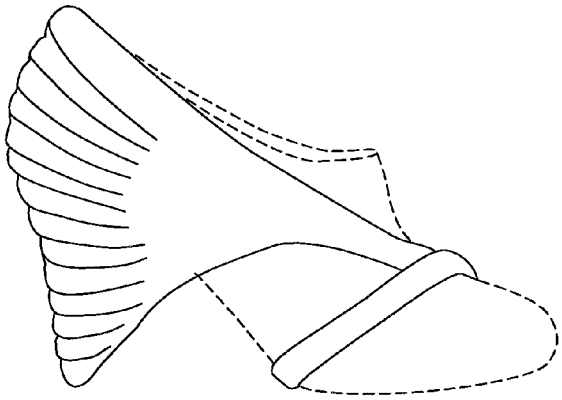
FIGS. 2*a*-2*b* show a heel protector according to one other embodiment of the heel protectors disclosed herein.
Figure 2B:
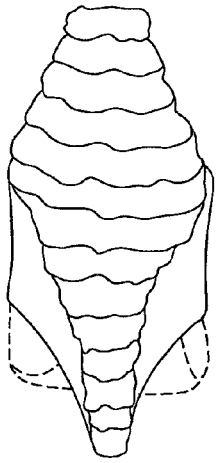
Figure 3A:
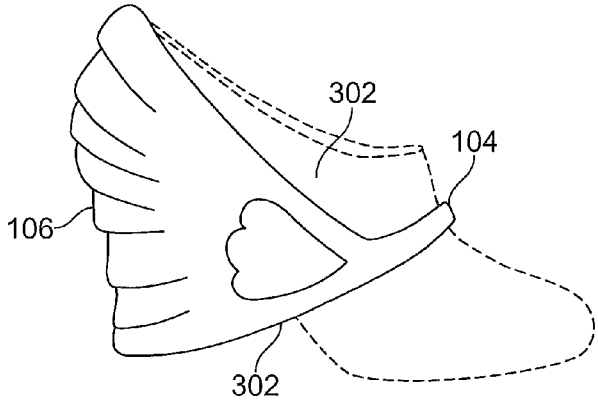
FIGS. 3*a*-3*b* show a heel protector according to one other embodiment of the heel protectors disclosed herein.
Figure 3B:
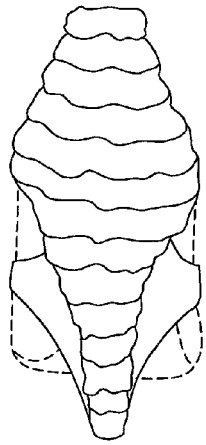
Figure 4A:
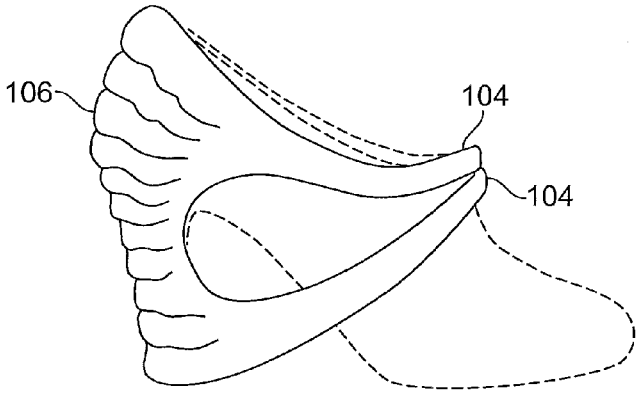
FIGS. 4*a*-4*b* show a heel protector according to one other embodiment of the heel protectors disclosed herein.
Figure 4B:
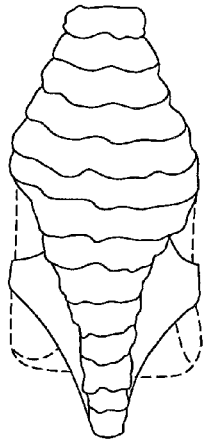
Figure 5A:
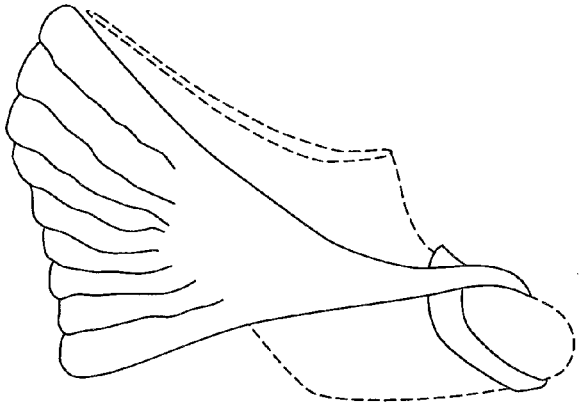
Figure 5B:
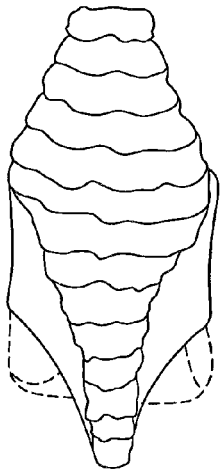
Figure 6A:
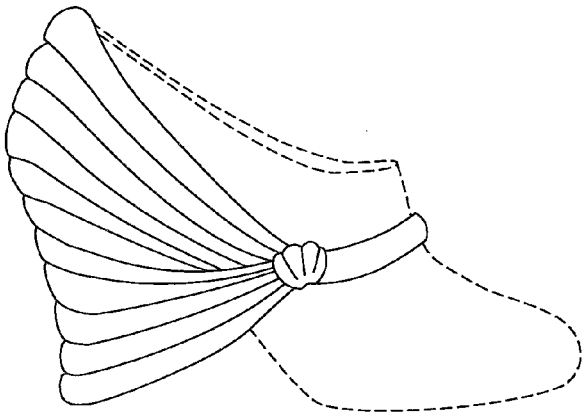
FIGS. 6*a*-6*b* show a heel protector according to one other embodiment of the heel protectors disclosed herein.
Figure 6B:
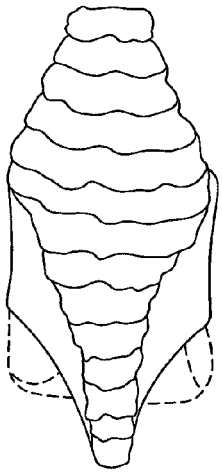
Figure 7A:
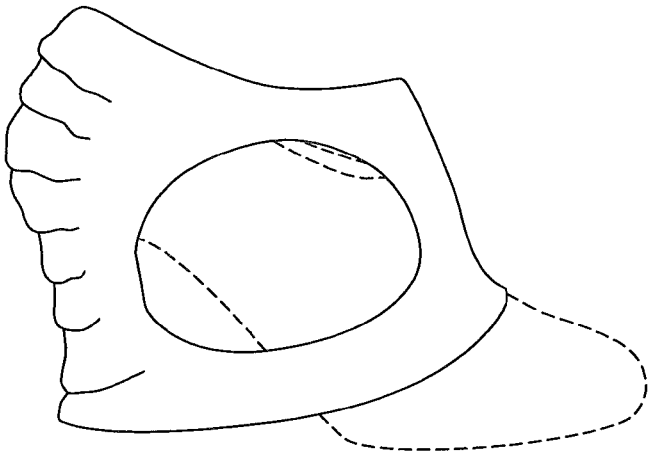
FIG. 7*a*-7*b* show a heel protector according to one other embodiment of the heel protectors disclosed herein.
Figure 7B:
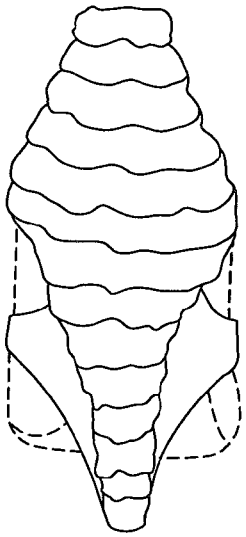
Figure 8A:
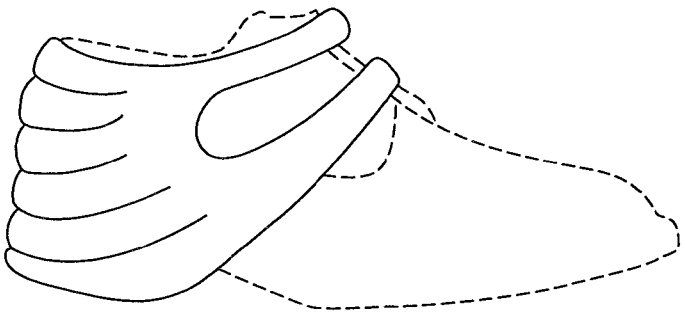
FIG. 8*a*-8*b* show a heel protector according to one other embodiment of the heel protectors disclosed herein.
Figure 8B:
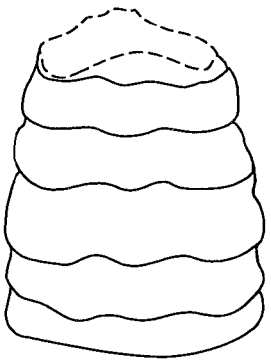
Figure 9A:
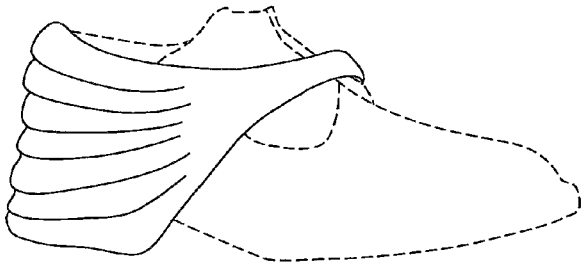
FIG. 9*a*-9*b* show a heel protector according to one other embodiment of the heel protectors disclosed herein.
Figure 9B:
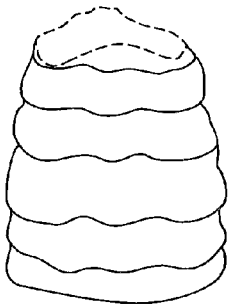
Figure 10A:
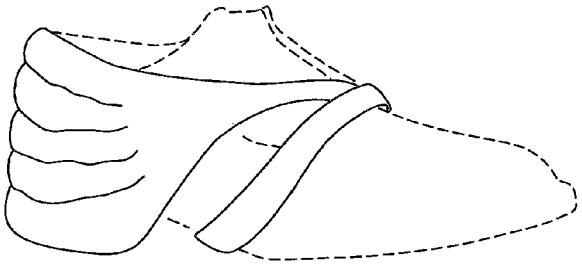
FIG. 10*a*-10*b* show a heel protector according to one other embodiment of the heel protectors disclosed herein.
Figure 10B:
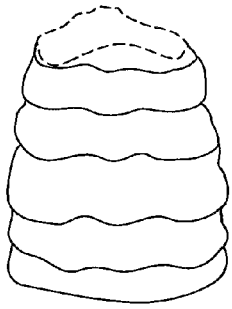

The heel protector may be formed in a variety of different shapes and sizes. For example, the strap portion 104 may have a sufficient length, flexibility, and/or shape to form a loop that crosses over the top and under the sole of a shoe as shown in FIGS. 2*a* and 10*a*. Additionally or alternatively, the strap section 104 may split into multiple intermediate strap sections 302 as shown in FIGS. 3*a* and 7*a*. The intermediate strips 302 generally form an opening there between that may be formed into any shape desired. In lieu of a single strap, multiple straps 104 may be used as shown in FIGS. 4*a* and 8*a*. The interface between the strap section 104 and the heel section 106 may includes a button, as shown in FIG. 6*a*. The button may be a functional closure or may provide reinforcement at the intersection of these sections. The button may also include an ornamental shape.

Figure 11:
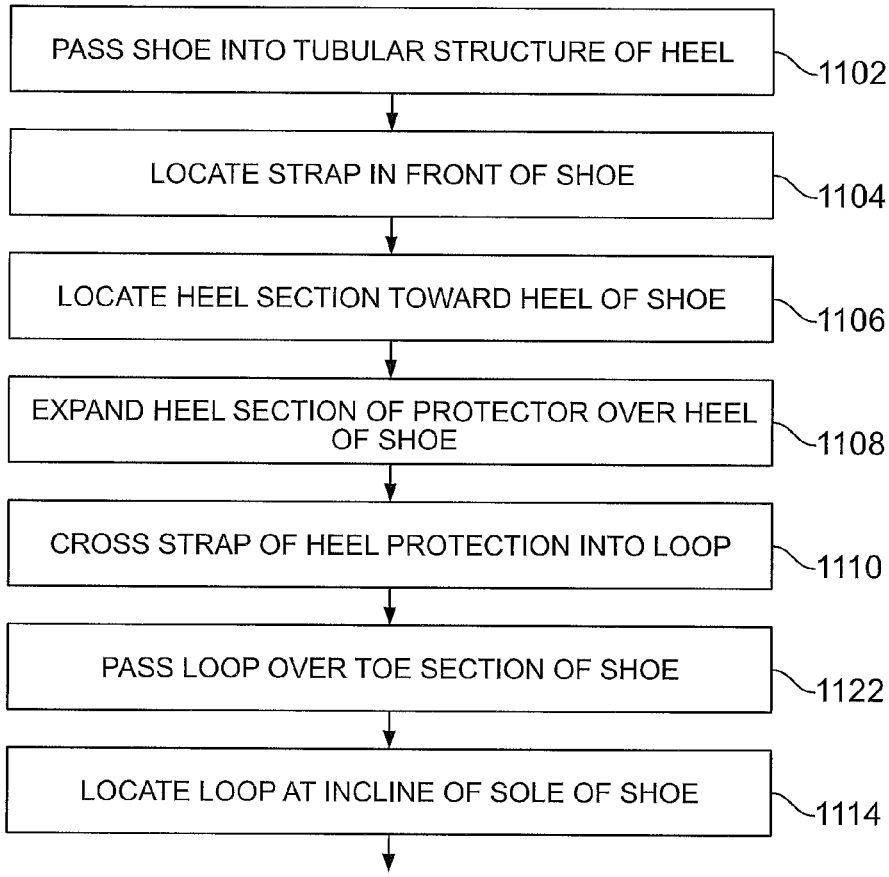
FIG. 11 shows a method for using a heel protector according to one other embodiment of the heel protectors disclosed herein.

Referring to FIG. 11, in at least one embodiment, the heel protector is used by passing a shoe into the tubular structure at 1102 so that the strap 104 is generally located in the front of the shoe at 1104 and the heel section 106 is located toward the heel of the shoe 102 at 1106. The protector may be placed on and located onto the shoe while the shoe is being worn or before the shoe is put on a foot. The protector may also be left on the shoe after the shoe is removed, so that the person need not keep taking the heel protector on and off. Thereafter, the heel section 106 and/or any folds may be expanded at 1108 to cover all or substantially the entire heel and rear portion of the shoe. In this instance, any folds will be unfolded and the heel section 106 will be stretched as necessary to provide the desired coverage over the heel and the rear portion of the shoe. The base 110 may be fit around and/or under the base of the heel of the shoe, while the opposite end of the heel section 106 may similarly be fit around and/over the top of the rear portion of the shoe. Minimizing coverage of the shoe 102 provides the most protection while limiting any interference with driving or any other activity being performed while the protector is being used.

The strap 104 may be sufficiently flexible so that the strap 104 may be crossed over the top of the shoe at 1110 and a loop created by crossing the strap 104 may be passed over the toe section of the shoe at 1112 as shown in FIGS. 2*a*-2*b*, 5*a*-5*b*, and 10*a*-10*b*. In this instance, the loop of the strap 104 is preferably located at the incline of the bottom or sole of the shoe at 1114 as shown in FIGS. 2*a* and 10*a*.

The shoe protector may also include openings to tailor the stretchability and other characteristics of the protector as shown in FIGS. 3*a* and 7*a*. For example, the strap 104 may split into a plurality of intermediate straps 302 that transition into the heel portion 106 as shown. Alternatively, the protector may include a plurality of straps 104 each transitioning into the heel portion 106 as shown in FIGS. 4*a* and 8*a*. The transition between the strap 104 and the heel portion 106 may include an ornamental feature as shown in FIG. 6*a*. The ornamental feature may be incorporated into a snap or button for the strap 104 to be connected releasably to the heel portion 106.

While the foregoing has been described in some detail for purposes of clarity and understanding, it will be appreciated by one skilled in the art, from a reading of the disclosure, that various changes in form and detail can be made without departing from the true scope thereof.

What is claimed is:

1. A heel protector comprising a tubular structure adapted to cover a heel of a shoe, the heel protector having a strap section and a heel section, wherein the strap section comprises a band of material having a first strap end and a second strap end, and wherein the heel section extends from each end of the first and second strap ends toward the heel of the shoe and wherein the heel section has a vertical height that increases toward the heel of the shoe to form a wedge shape heel section for covering at least a portion of a back and two sides of the shoe, and at least a portion of a bottom surface of the heel, the heel section having:

an inner surface located within the tubular structure;

an outer surface located outside of the tubular structure;

a plurality of alternating annular strips of material located on the outer surface of the heel section, the material having a first thickness, wherein the thickness is a dimension between the inner surface and the outer surface of the tubular structure at the heel section; and annular ridges separating the plurality of the annular strips, the annular ridges having a second thickness smaller than the first thickness of the annular strips.

2. The heel protector of claim 1, wherein the tubular structure is made from a stretchable material.

3. The heel protector of claim 2, wherein the stretchable material comprises at least one of silicon, rubber, latex, spandex, and gel.

4. The heel protector of claim 1, wherein the strap and the heel section form a continuous tubular structure.

5. The heel protector of claim 1, wherein the tubular structure is a continuous tubular structure and wherein the a plurality of alternating annular strips of material each have a height that increases towards the back surface of the heel to form wedge shaped annular strips.

6. A method comprising;

passing a shoe through a tubular structure of a heel protector, the heel protector having a strap section comprising a band of material having a first strap end and a second strap end and a heel section extending from each end of the strap section forming a wedge shape for covering a back surface and two sides of the shoe, and at least a portion of a bottom surface of the heel, the heel section comprising an inner surface located within the tubular structure, an outer surface located outside of the tubular structure, a plurality of alternating annular strips of material located on the outer surface, the material having a first thickness and annular ridges separating each annular strip, each annular ridge having a second thickness thinner than the first thickness of the annular strips, wherein the thickness is a dimension between the inner surface and the outer surface;

locating the strap over a front of the shoe;

locating the heel section over a heel of the shoe; and expanding vertically the heel section.

7. The method of claim 6, comprising forming a loop by crossing the strap and passing the loop over a toe section of the shoe.

8. The method of claim 7, comprising locating the loop at an incline of a sole of the shoe.

9. The method of claim 6, wherein the tubular structure of the heel protector is made from a stretchable material.

10. The method of claim 9, wherein the stretchable material comprises at least one of silicon, rubber, latex, spandex, and gel.

11. The method of claim 6, wherein the strap and the heel section form a continuous tubular structure.

12. A method comprising;

passing a shoe through a continuous tubular structure of a heel protector, the heel protector having a strap section that fits over a front surface of the shoe comprising a band of material having a first strap end and a second strap end and a heel section extending from each end of the strap section forming a wedge shape for covering a back surface and two sides of the shoe, and at least a portion of a bottom surface of the heel, the heel section comprising an inner surface located within the tubular structure, an outer surface located outside of the tubular structure, a plurality of alternating annular strips of material located on the outer surface, the material having a first thickness and annular ridges separating each annular strip, the annular ridges having a second thickness thinner than the first thickness of the annular strips, wherein the thickness is a dimension between the inner surface and the outer surface;

locating the strap over a front of the shoe;

locating the heel section over a heel of the shoe;

expanding vertically the heel section so that the heel section covers the a back surface and two sides of the shoe;

forming a loop by crossing the strap and passing the loop over a toe section of the shoe; and locating the loop at an incline of a sole of the shoe.

13. The method of claim 12, wherein the tubular structure of the heel protector is made from a stretchable material.

14. The method of claim 13, wherein the stretchable material comprises at least one of silicon, rubber, latex, spandex, and gel.

* * * * *